US005168826A

United States Patent [19]

Hirose

[11] Patent Number: 5,168,826

[45] Date of Patent: Dec. 8, 1992

[54] STITCHING SEWING MACHINE HAVING INCLINED NEEDLE AXIS

[75] Inventor: Tokuzo Hirose, Ashiya, Japan

[73] Assignee: Hirose Manufacturing Company, Limited, Osaka, Japan

[21] Appl. No.: 736,052

[22] Filed: Jul. 26, 1991

[51] Int. Cl.[5] ..... D05B 57/14

[52] U.S. Cl. ..... 112/181; 112/228

[58] Field of Search ..... 112/181, 182, 183, 196, 112/228, 443, 230, 231, 159, 226

[56] References Cited

U.S. PATENT DOCUMENTS

| | | | |
|---|---|---|---|
| 2,690,723 | 10/1954 | Sudo | 112/159 |
| 3,033,139 | 5/1969 | Tateishi | 112/159 |
| 3,362,362 | 1/1968 | Bono | 112/181 X |
| 4,296,701 | 10/1981 | Larsen | 112/181 X |
| 4,771,715 | 9/1988 | Inagaki | 112/443 |
| 4,884,520 | 12/1989 | Shimizu | 112/231 |
| 5,109,783 | 5/1992 | Shimizu | 112/231 |

FOREIGN PATENT DOCUMENTS

| | | | |
|---|---|---|---|
| 533176 | 11/1954 | France | 112/181 |

*Primary Examiner*—Werner H. Schroeder
*Assistant Examiner*—Paul C. Lewis
*Attorney, Agent, or Firm*—Wenderoth, Lind & Ponack

[57] ABSTRACT

An axis of a needle is inclined with respect to an imaginary plane perpendicular to an axis of a lower shaft. The lowermost position of the needle where it comes closest to a loop taker is spaced from the loop taker in the axial direction thereof in proportion to the degree of inclination of the axis of the needle. As a result, the length of a bobbin accommodated in the loop taker can be extended along the axis thereof, thereby permitting the amount of thread loaded on the bobbin to be increased. The amount of thread drawn by a needle thread take-up may remain the same and need not be changed.

6 Claims, 9 Drawing Sheets

STITCHING SEWING MACHINE HAVING INCLINED NEEDLE AXIS

BACKGROUND OF THE INVENTION

1. Field of the Invention

The present invention relates to a sewing machine for stitching.

2. Description of the Prior Art

FIG. 1 shows in cross section a typical prior art construction of a horizontal axis full rotary loop taker including a hook body 1 and a bobbin case holder 2 supported in the hook body 1. A bobbin case 5 indicated by imaginary lines is mounted in the bobbin case holder 2, the bobbin case 5 accommodating a bobbin 4 on which is wound thread 3. The hook body 1 is secured to a horizontally extending lower shaft 6 of a sewing machine and is rotated thereby. A needle 7 reciprocates up and down in directions indicated by arrow 8, the lowermost point of the path of travel of the needle 7 being indicated by reference numeral 9. The axis of rotation of the bobbin 4 is aligned with or parallel to the axis of the lower shaft 6. In the thus constructed horizontal axis full rotary loop taker, a bobbin case holder rib 10 formed on the outer circumferential surface of the bobbin case holder 2 engages with a hook groove 11 formed in the hook body 1. As the hook body 1 is rotated, an upper thread loop is seized by a loop seizing hook or beak 16 and is moved slidingly along a bottom 14 of the bobbin case holder 2 while contacting the lower part of the bottom 14 of the bobbin case holder 2, thus accomplishing a thread cast-off operation.

In the above prior art arrangement, if the amount of the thread loaded on the bobbin 4 is to be increased, it is necessary to extend the axial length H of the bobbin 4. There are two possible methods of extending the axial length H of the bobbin 4, that is, (a) to extend the bobbin 4 in the direction toward the open end of the bobbin case holder 2 (in the rightward direction in FIG. 1) or (b) to enlarge the bottom 14 of the bobbin case holder 2 in the leftward direction in FIG. 1 and extend the bobbin 4 in the direction toward the bottom 14.

If the bobbin 4 is extended in the direction toward the open end of the bobbin case holder 2 in accordance with the above method (a), when the needle 7 moves down to its lowermost point 9, the needle point is positioned inwardly of the peripheral surface of the mass of bobbin thread 3 wound on the bobbin 4, causing the needle 7 to stick into the thread 3 wound on the bobbin 4 and thereby breaking the thread 3 wound on the bobbin 4. On the other hand, if the bottom 14 of the bobbin case holder 2 is extended in the leftward direction in FIG. 1, the thread on the needle will be caught on the lower part of the bottom 14 of the bobbin case holder 2, thus preventing the cast-off operation of the thread and therefore stopping the sewing operation.

SUMMARY OF THE INVENTION

It is an object of the invention to provide a sewing machine that permits the amount of thread to be loaded onto a bobbin to be increased while avoiding the above prior art problems arising from the extension of the length of the bobbin.

To accomplish the above object, a sewing machine according to the invention has a loop taker supporting therein a bobbin on which thread is wound, the bobbin being mounted on a lower shaft having a horizontally extending axis. The axis of a needle, which is driven to move toward and away from the loop taker in synchronism with the motion of the lower shaft, is inclined with respect to an imaginary plane perpendicular to the axis of the lower shaft.

Thus, according to the invention, since the axis of the needle is inclined with respect to the imaginary plane perpendicular to the axis of the lower shaft, the lowermost position of the needle where it comes closest to the loop taker can be spaced from the loop taker in the axial direction thereof. This allows the length of the bobbin to be extended along its axis in proportion to the distance thus spaced, so that the amount of the thread to be loaded onto the bobbin can be increased. The amount of thread drawn by the needle thread take-up may remain the same as in the previous construction and need not be changed. Accordingly, the present invention eliminates problems such as breaking of the thread or difficulty of a needle thread cast-off operation, as described in connection with the aforementioned prior art arrangement.

As described above, according to the invention, since the axis of the needle is inclined with respect to the imaginary plane perpendicular to the axis of the lower shaft, the lowermost position of the needle can be spaced from the bobbin in the axial direction of the loop taker. This allows the axial length of the bobbin to be extended and thereby permits the amount of thread on the bobbin to be increased.

Furthermore, according to the invention, the amount of thread drawn by the needle thread take-up may remain the same as in the previous construction, which provides the excellent advantage that the invention can be applied extensively for existing sewing machines.

BRIEF DESCRIPTION OF THE DRAWINGS

These and other objects, features, and advantages of the invention will become more apparent from the following detailed description taken with reference to the accompanying drawings, wherein:

FIG. 2A is a side view of the machine shown in FIG. 2;

DETAILED DESCRIPTION OF THE PREFERRED EMBODIMENTS

Figure 1:
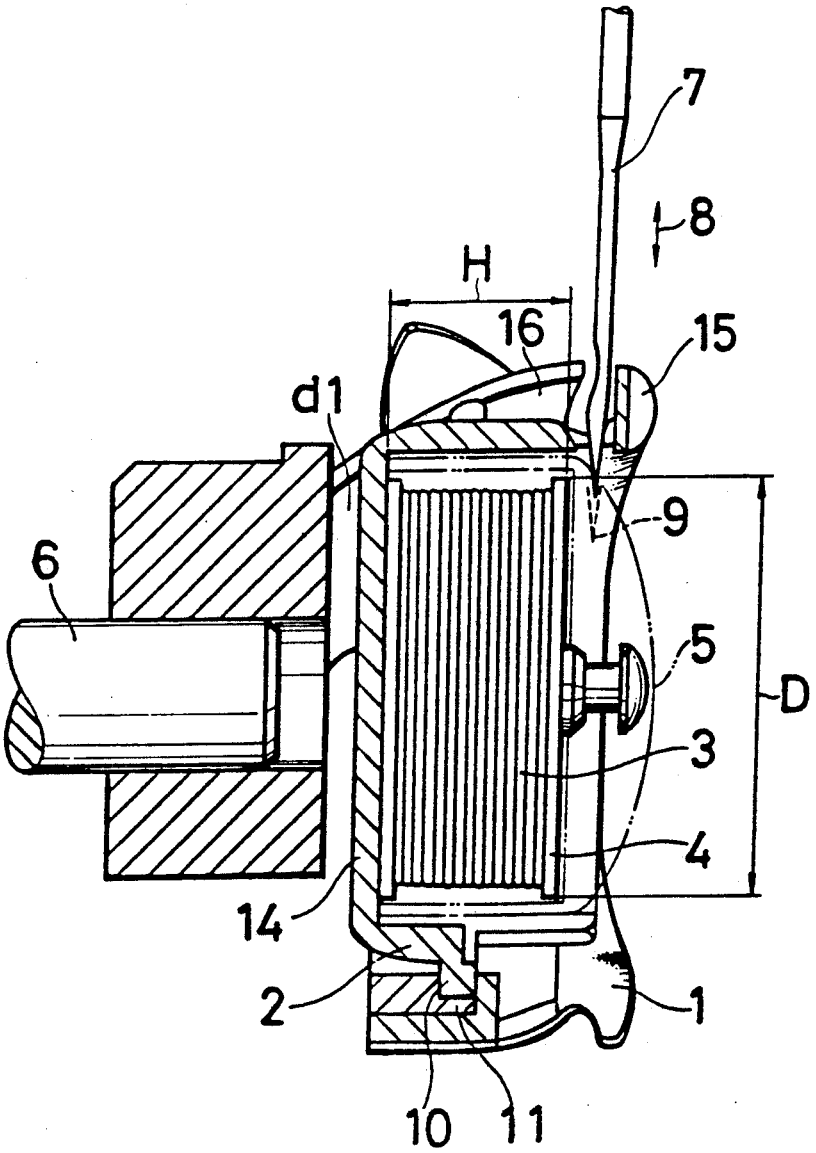
Fig. 1 Prior Art
FIG. 1 is a cross-sectional view of a typical prior art device.

Referring now to the drawings, preferred embodiments of the invention are described below.

Figure 2:
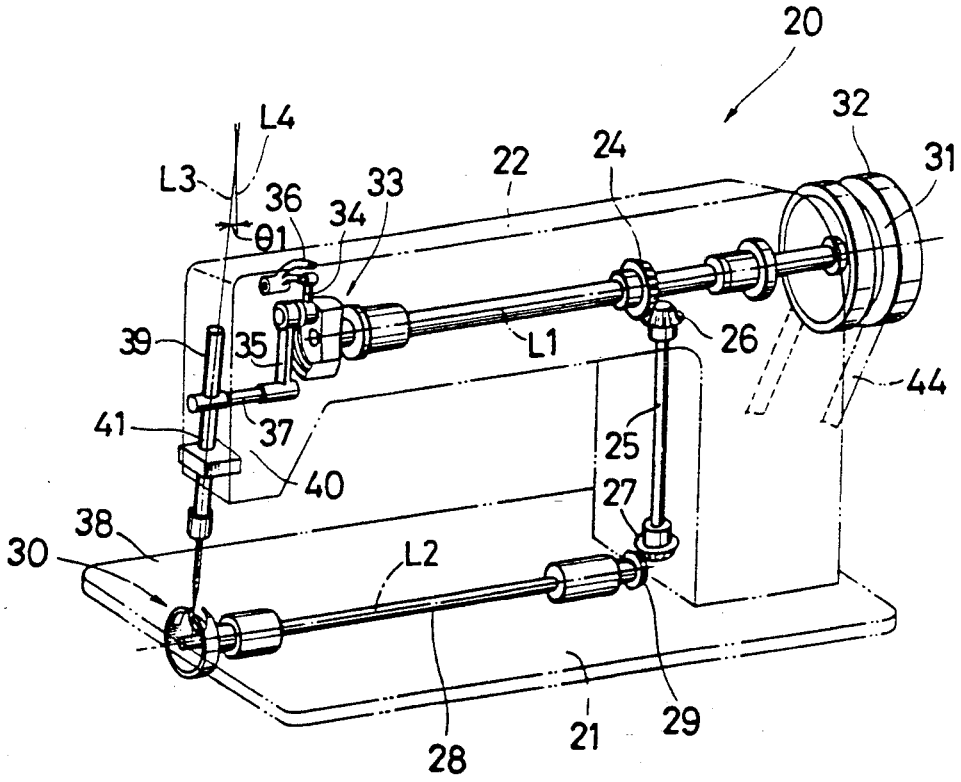
FIG. 2 is a perspective view of a sewing machine according to one embodiment of the invention.
Figure 3:
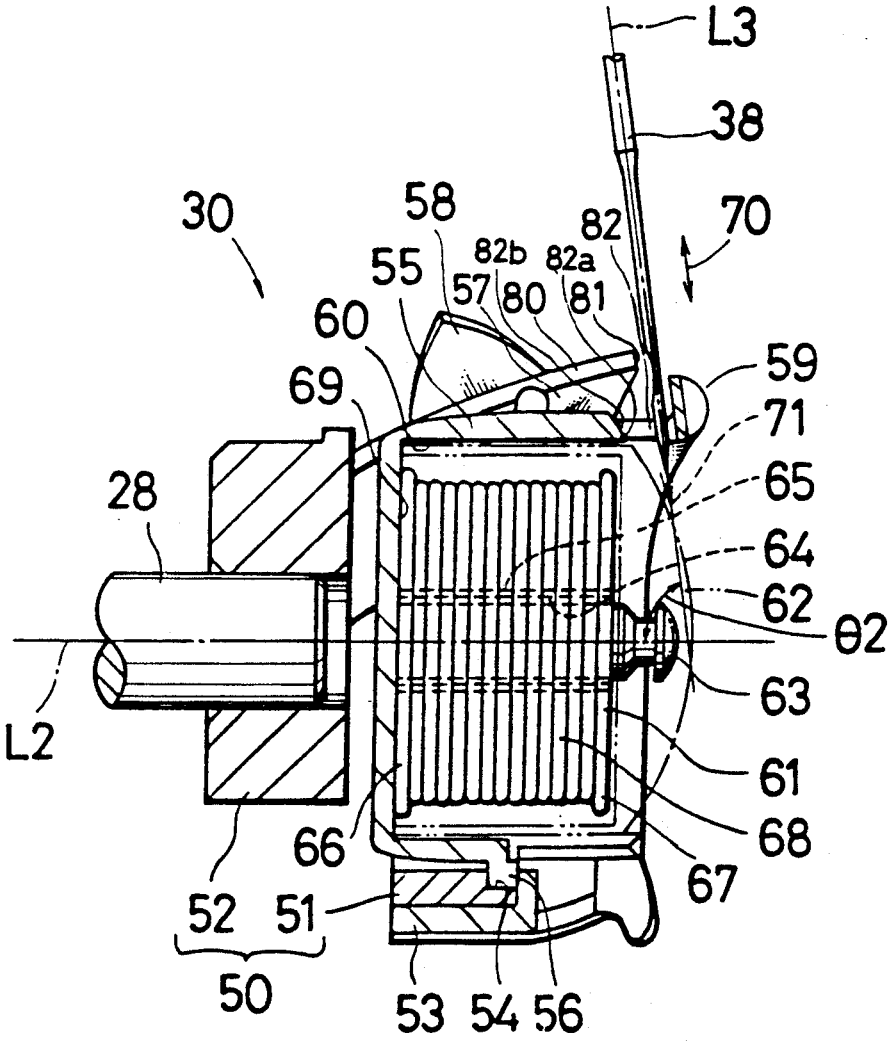
FIG. 3 is a cross-sectional view of a horizontal axis full rotary loop taker mounted on such sewing machine.

FIG. 2 is a perspective view of a sewing machine 20 according to one embodiment of the invention, FIG. 2A is a side view thereof, and FIG. 3 is a cross sectional view of a horizontal axis full rotary loop taker 30 mounted on the sewing machine 20. The sewing machine 20 includes a horizontal bed 21 and a main body 22 mounted on the bed 21. The main body 22 is provided with an upper shaft 23 which is driven to rotate about a horizontally extending axis L1. To the upper shaft 23 is fixed a bevel gear 24 which engages with a bevel gear 26 fixed to one end of an interlocking shaft 25 that thereby is driven to rotate about a vertically extending axis thereof. Fixed to the other end of the interlocking shaft 25 is a bevel gear 27 which engages with a bevel gear 29 fixed to one end of a lower shaft 28. The lower shaft 28 thus is driven to rotate about a rotation axis L2 lying in a vertical plane containing the rotation axis L1 of the upper shaft 23, the axes L1 and L2 being parallel with each other. The horizontal axis full rotary loop taker 30 is mounted on the other end of the lower shaft 28.

On one end of the upper shaft 23 is mounted a pulley or wheel 32 on an outer circumferential surface of which is formed a V-shaped groove 31. A needle thread take-up cam 33 is fitted to the other end of the upper shaft 23. The take-up cam 33 is provided with a needle thread take-up link 34 and a crank shaft 35 mounted concentrically with the take-up link 34. The thread take-up link 34 is connected to a needle thread take-up 36 such that needle thread take-up 36 is moved up and down in reciprocating fashion.

Fitted to the crank shaft 35 is one end of a connecting rod 37. A needle holder 39 in which is detachably fitted a needle 38 is fixed to the other end of the connecting rod 37. The needle holder 39 is inserted through an aperture 41 formed in a guide member 40 fixed to the main body 22. An axis L3 of the needle 38 is inclined toward the take-up cam 33 at an angle of Θ1, in a plane containing the rotation axes L1 and L2 of the upper and lower shafts 23 and 28, with respect to a vertical line L4 that lies in an imaginary plane perpendicular to the rotation axis L2 of the lower shaft 28. The angle Θ1 is, for example, 3 to 10 degrees.

The handwheel 32 is driven for rotation by a V-belt 44 extending from a driving source (not shown) and fitted around the V-shaped groove 31. When the handwheel 32 is rotated, the upper shaft 23 is rotated about its rotation axis L1, thereby moving the needle thread take-up 36 and the needle 38 up and down in reciprocating fashion. The rotation of the upper shaft 23 is transmitted via the interlocking shaft 25 to the lower shaft 28 so that the lower shaft 28 is rotated about its rotation axis L2. In the thus constructed sewing machine 20, the upper shaft 23 and the lower shaft 28 have parallel axes lying in the same vertical plane, and the needle 38 reciprocates up and down in such a way as to space itself away from a bobbin 61 hereinafter described, with its path of travel inclined at angle of Θ1 with respect to the vertical line L4.

In the full rotary loop taker 30 mounted on the sewing machine 20, there is provided a hook body 50 which includes a hook body shell 51 and a mounting member 52. The mounting member 52 is secured to the lower shaft 28 having the horizontally extending axis of rotation L2. A gib 53 is fixed to the hook body shell 51 to form a hook groove 54 which extends circularly in an imaginary plane perpendicular to the rotation axis L2 of the lower shaft 28. On the outer circumferential surface of a bobbin case holder 55 is formed a bobbin case holder rib 56 which engages with the hook groove 54 to support the bobbin case holder 55 in the hook body 50. The hook body 50 further includes a loop seizing beak 57 and a spring 58. A protrusion on a rotation restraining member (not shown) fixed to the sewing machine body engages with a rotation restraining notch 59 formed on the bobbin case holder 55, to prevent the rotation of the bobbin case holder 55 while the hook body 50 is being driven for rotation about the rotation axis L2 of the lower shaft 28.

A bobbin case 62 housing a bobbin 61 is mounted in a cavity 60 of the bobbin case holder 55. The bobbin 61 includes a barrel 65 of a right cylindrical shape having a center hole 64 through which is inserted a stud 63, and a pair of flanges 66 and 67 which are fitted to opposite ends of the barrel 65. Thread 68 is wound on the bobbin 61 through the center hole 64 of which is inserted the stud 63 extending at right angles from a bottom 69 of the bobbin case holder 55. The axis of the stud 63, and thus the axis of rotation of the bobbin 61, is concentric with the rotation axis L2 of the lower shaft 28. The needle 38 reciprocates up and down in directions shown by arrow 70, the lowermost point of the path of travel of the needle 38 being indicated by reference numeral 71. The lowermost point 71 of the needle 38 is determined so that the needle does not strike the flange 67.

Figure 4:
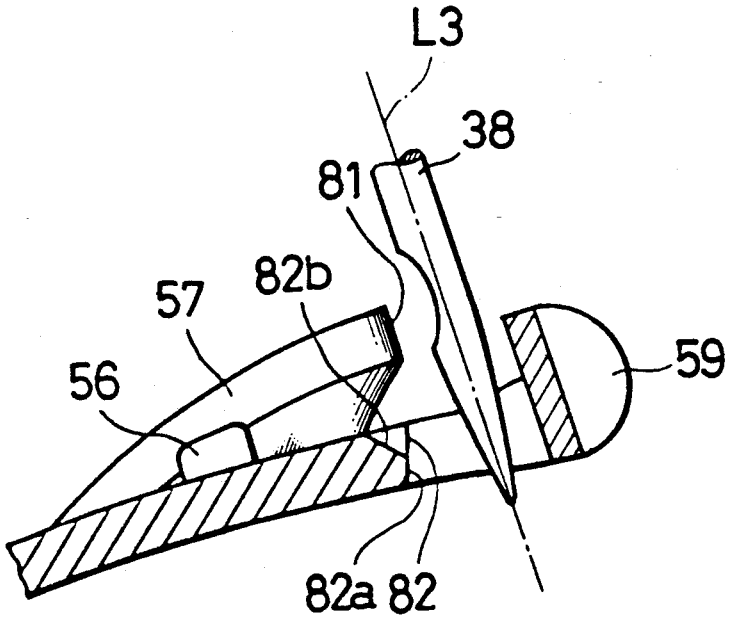
FIG. 4 is an enlarged view of a loop seizing beak and adjacent parts thereof.

Referring to FIG. 4, an end portion 80 of the loop seizing beak 57 formed on the hook body 50 has an end face 81 formed parallel to the reciprocating path of the needle 38, i.e., to the axis L3 of the needle holder 39. The end face 81 therefore forms an acute angle Θ2 with the axis L2 of the lower shaft 28 (see FIG. 5). The angle Θ2 is, for example, 80 to 87 degrees. When the needle 38 enters a needle guide 82 in the bobbin case holder 55, the end face 81 of the loop seizing beak 57 is substantially parallel to the path of travel of the needle 38. Also, if the point of the needle 38 strikes an inclined face **82*b* of the needle guide, the needle 38 will be guided into the needle guide 82 by such inclined face 82*b***.

Figure 5:
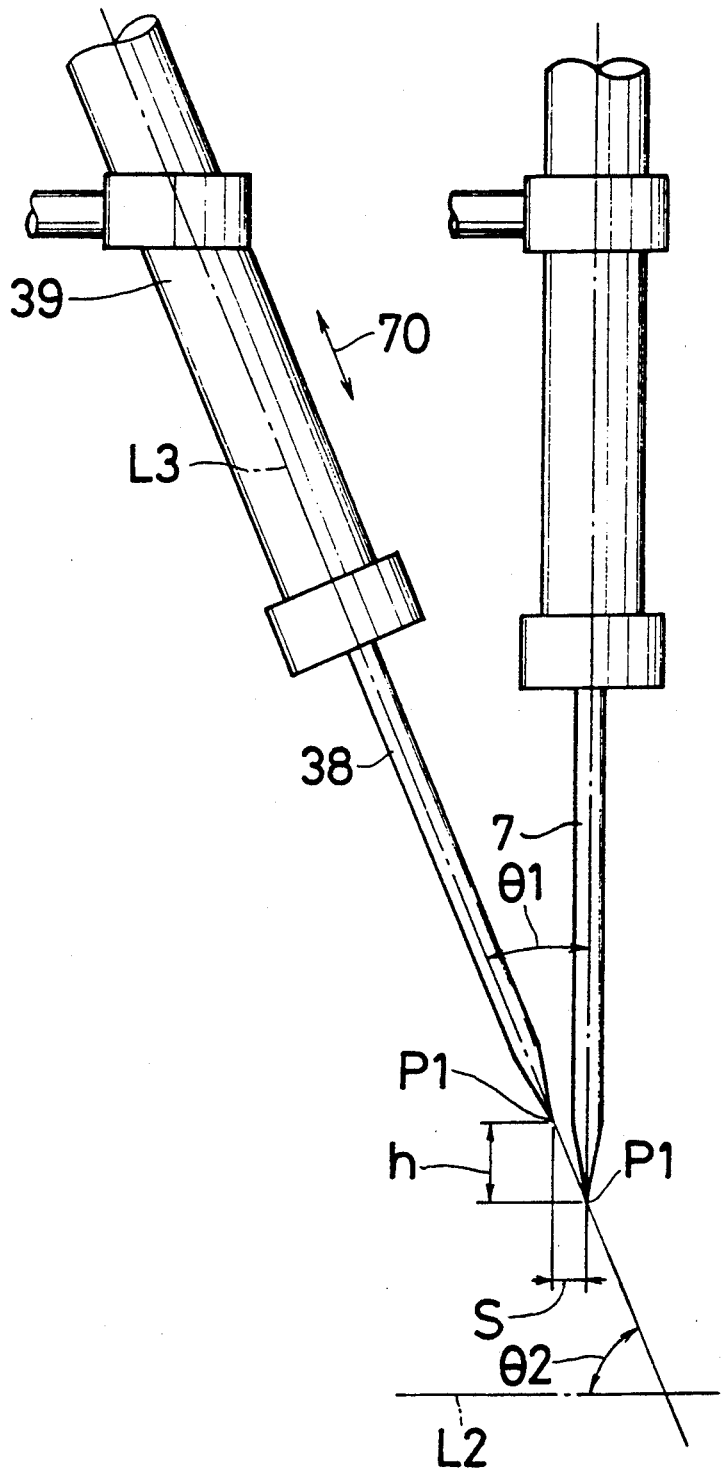
FIG. 5 is an enlarged view illustrating the distance of shifting of the point of a needle installed in such sewing machine.

FIG. 5 is a diagram explaining the distance of shifting of the point Pl of the needle 38 in the sewing machine 20. When compared with the needle 7 of the aforementioned prior art arrangement, the needle 38 of the invention is inclined at an angle of Θ1 with respect to the vertical, i.e. line L4, or Θ2 with respect to the rotation axis L2 of the lower shaft 28. The point P1 of the needle 38 is shifted from a point P0 of the needle 7 by a horizontal distance s. When the difference in vertical height between the point P0 and the point P1 where the needle 7 and the needle 38 are at their respective lowermost points is denoted as h, the distance s is given by equation (1) or (2) below.

$$s = h.\tan\Theta 1 \quad (1)$$

$$s = h/\tan\Theta 2 \quad (2)$$

With the path of travel of the needle 38 thus inclined by angle Θ2 to the rotation axis L2 of the lower shaft 28, the length of the bobbin 61, i.e. the axial length of the barrel 65 on which the thread 68 is wound with the flanges 66 and 67 fitted to opposite ends thereof, can be extended by the distance s, thereby permitting the amount of the thread 68 on the bobbin to be increased. Also, since the upper shaft 23 can be made shorter, it is possible to reduce the vibration of the upper shaft 23. Furthermore, since the needle 38 is moved in an inclined direction, the vibration of the needle 38 is reduced.

Figure 6:
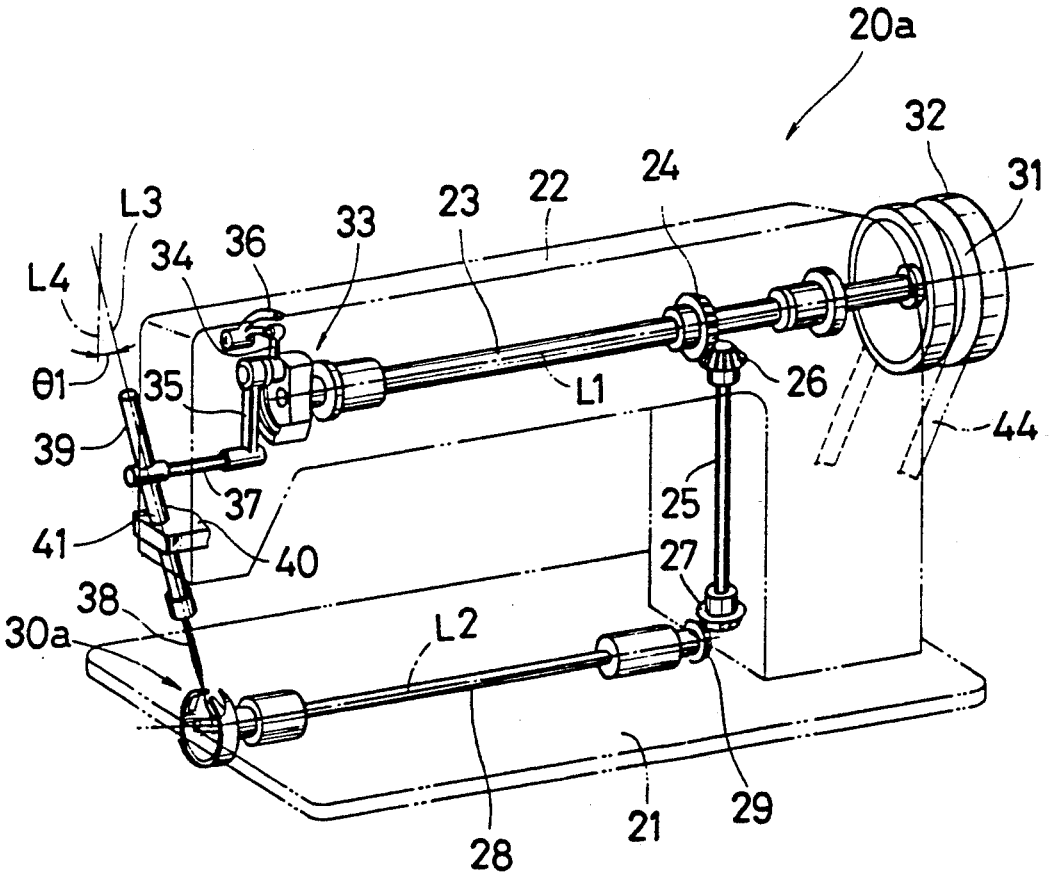
FIG. 6 is a perspective view of a sewing machine according to another embodiment of the invention.
Figure 7:
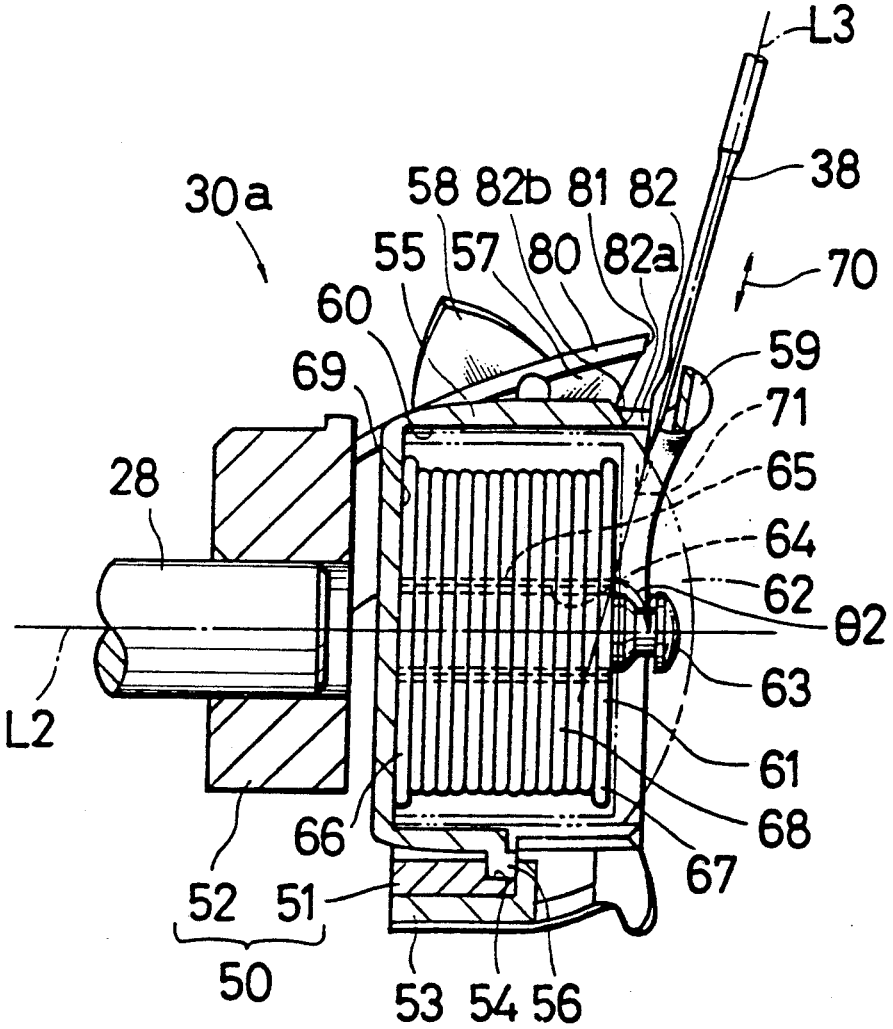
FIG. 7 is a cross-sectional view of a horizontal axis full rotary loop taker mounted on such sewing machine.

FIG. 6 is a perspective view of a sewing machine 20*a* according to another embodiment of the invention, and FIG. 7 is a cross sectional view of a horizontal axis full rotary loop taker 30*a* mounted on the sewing machine 20*a*. Like reference numerals are used to designate parts corresponding to those in the foregoing embodiment shown in FIGS. 2 to 5.

In this embodiment, one end of a connecting rod 37 is fitted to a crank shaft 35. A needle holder 39 in which a needle 38 is detachably fitted is fixed to the other end of the connecting rod 37. The needle holder 39 is inserted through an aperture 41 formed in a guide member 40 fixed to the main body 22. An axis L3 of the needle 38 is inclined toward a take-up cam 33 at an angle of Θ3, in a plane containing the rotation axes L1 and L2 of the upper and lower shafts 23 and 28, with respect to a vertical line L4 that lies in an imaginary plane perpendicular to the rotation axis L2 of the lower shaft 28. The angle Θ3 is, for example, 3 to 10 degrees.

The handwheel 32 is driven for rotation by a V-belt 44 extending from a driving source (not shown) and fitted around the V-shaped groove 31. When the handwheel 32 is rotated, the upper shaft 23 is rotated about its rotation axis L1, thereby moving the needle thread take-up 36 and the needle 38 up and down in reciprocating fashion. The rotation of the upper shaft 23 is transmitted via an interlocking shaft 25 to the lower shaft 28 so that the lower shaft 28 is rotated about its rotation axis L2. In the thus constructed sewing machine 20*a*, the upper shaft 23 and the lower shaft 28 have parallel axes lying in the same vertical plane, and the needle 38 reciprocates up and down in such a way as to space itself away from a bobbin 61 hereinafter described, with its path of travel inclined at angle Θ3 with respect to the vertical line L4.

In the full rotary loop taker 30*a* mounted on the sewing machine 20*a*, there is provided a hook body 50 which includes a hook body shell 51 and a mounting member 52, the mounting member 52 is secured to the lower shaft 28 having a horizontally extending axis of rotation. A gib 53 is fixed to the hook body shell 51 to form a hook groove 54 which extends circularly in an imaginary plane perpendicular to the rotation axis L2 of the lower shaft 28. On the outer circumferential surface of the bobbin case holder 55 is formed a bobbin case holder rib 56 which engages in the hook groove 54 to support the bobbin case holder 55 in the hook body 50. The hook body 50 further includes a loop seizing beak 57 and a spring 58. A protrusion on a rotation restraining member (not shown) fixed to the sewing machine body engages with a rotation restraining notch 59 formed on the bobbin case holder 55, to prevent the rotation of the bobbin case holder 55 while the hook body 50 is being driven for rotation about the rotation axis L2 of the lower shaft 28.

A bobbin case 62 housing a bobbin 61 is mounted in a cavity 60 of the bobbin case holder 55. The bobbin 61 includes a barrel 65 of a right cylindrical shape having a center hole 64 through which is inserted a stud 63, and a pair of flanges 66 and 67 which are fitted to opposite ends of the barrel 65. Thread 68 is wound on the bobbin 61 through the center hole 64 of which is inserted the stud 63 extending at right angles from the bottom 69 of the bobbin case holder 55. The axis of the stud 63, and thus the axis of rotation of the bobbin 61, is concentric with the rotation axis L2 of the lower shaft 28. The needle 38 reciprocates up and down in directions indicated by arrow 70, the lowermost point of the path of travel of the needle 38 being indicated by reference numeral 71. The lowermost point 71 of the needle 38 is determined so that the needle does not strike the flange 67.

Figure 8:
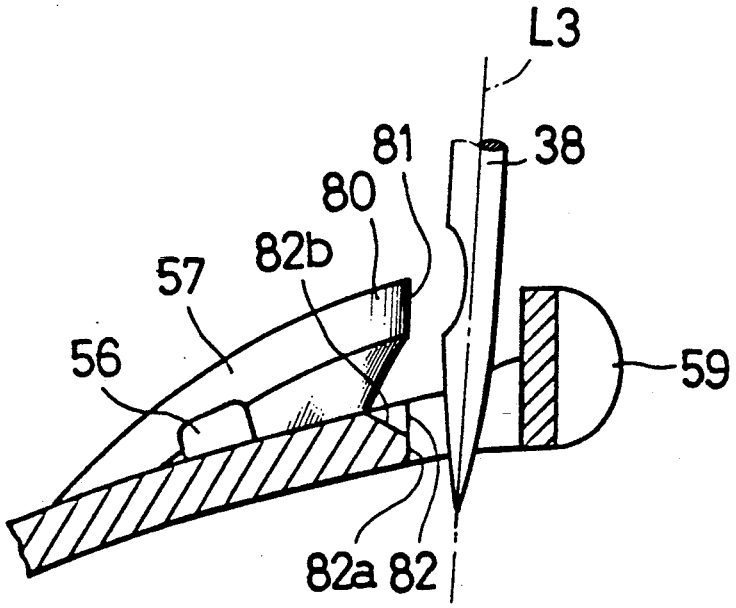
FIG. 8 is an enlarged view of a loop seizing beak and adjacent parts thereof.

Referring to FIG. 8, an end portion 80 of the loop seizing beak 57 formed on the hook body 50 has an end face 81 formed parallel to the reciprocating path of the needle 38, i.e., to the axis L3 of the needle holder 39. The end face 81 therefore forms an acute angle Θ4 with the axis L2 of the lower shaft 28 (see FIG. 9). The angle is, for example, 80 to 87 degrees. When the needle 38 enters a needle guide 82 in the bobbin case holder 55, an end face 82*a* of the needle guide 82 and the end face 81 of the loop seizing beak 57 are substantially parallel to the path of travel of the needle 38. Also, if the point of the needle 38 strikes an inclined face 82*b* of the needle guide, the needle 38 can be guided into the needle guide 82 by such inclined face 82*b*.

Figure 9:
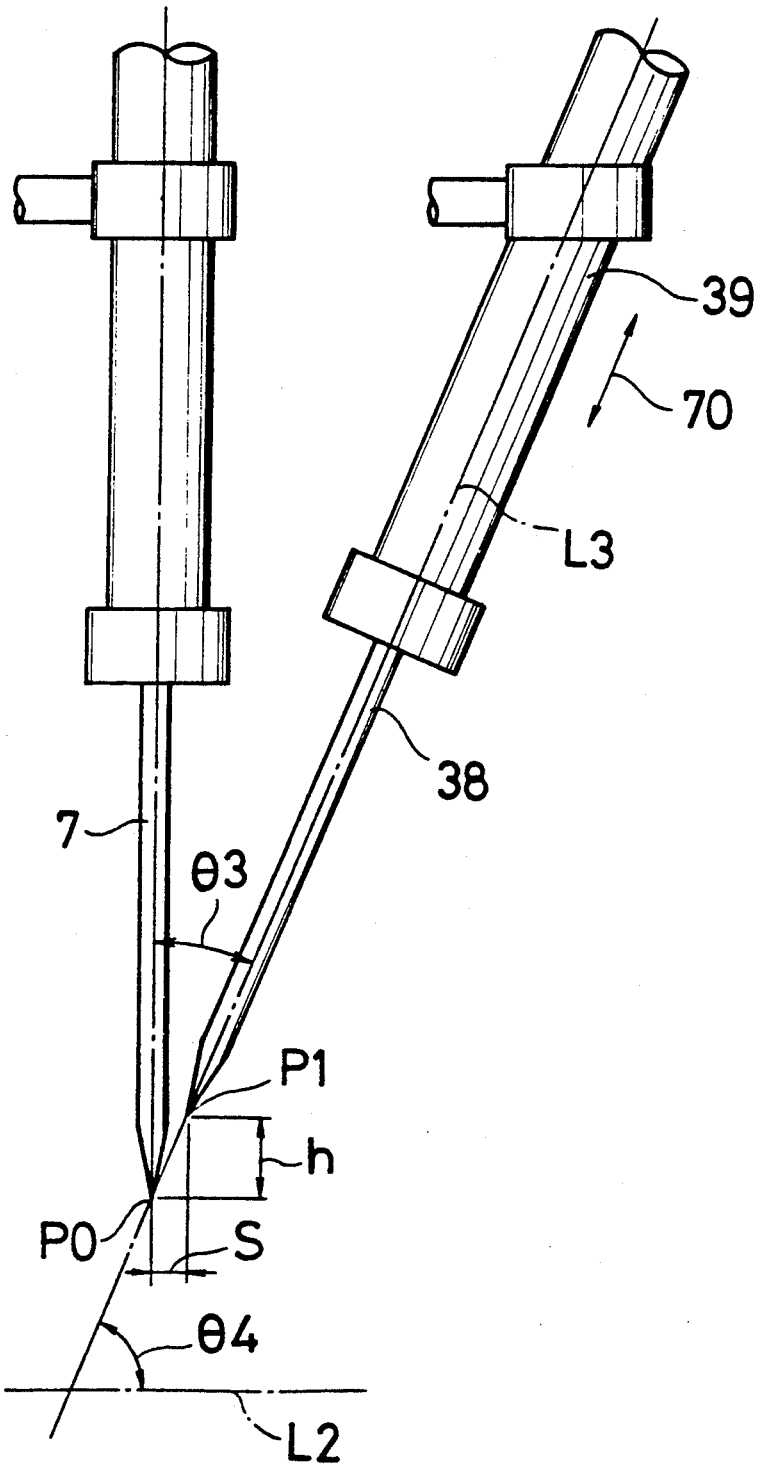
FIG. 9 is an enlarged view illustrating the distance of shifting of the point of a needle installed in such sewing machine.

FIG. 9 is a diagram explaining the distance of shifting of the point P1 of the needle 38 in the sewing machine 20*a*. When compared with the needle 7 of the aforementioned prior art arrangement, the needle 38 of the invention is inclined at an angle of Θ3 with respect to the vertical line L4, or Θ4 with respect to the rotation axis L2 of the lower shaft 28. The point P1 of the needle 38 is shifted from the point P0 of the needle 7 by a horizontal distance s. When the difference in vertical height between the point P0 and the point P1 where the needle 7 and the needle 38 are at their respective lowermost points is denoted as h, the distance is given by equation (3) or (4) below.

$$s = h.\tan\Theta 3 \quad (3)$$

$$s = h/\tan\Theta 4 \quad (4)$$

With the path of travel of the needle 38 thus inclined by angle Θ4 to the rotation axis L2 of the lower shaft 28, the length of the bobbin 61, i.e. the axial length of the barrel 65 on which the thread 68 is wound with the flanges 66 and 67 fitted to opposite ends thereof, can be extended by the distance s, thereby permitting the amount of the thread 68 on the bobbin to be increased.

Thus, the invention has an excellent advantage that the amount of the thread loaded onto the bobbin can be significantly increased. Furthermore, the invention offers the advantage that even when the amount of the thread 68 loaded onto the bobbin 61 is increased, there is no need to change the amount of the thread drawn by the needle thread take-up 36 of the sewing machine 20 or 20*a* since, as described, the needle 38 is inclined by the angle Θ2 or Θ4 to the rotation axis L2 of the lower shaft 28. This facilitates the application of the invention to existing sewing machines.

The invention also may be applied to sewing machines in which the bobbin case 62 is constructed integrally with the bobbin case holder 55. Further, the bobbin case holder 55 does not necessarily have to be provided with the stud 63.

In both of the above embodiments, the loop taker described is of the full rotary type, but in a further embodiment, the invention may be employed with half rotary loop takers.

The invention may be embodied in other specific forms without departing from the spirit or essential characteristics thereof. The above embodiments therefore are to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. In a sewing machine including a lower shaft having a horizontal rotation axis and supporting a loop taker in which is mounted a bobbin having thread wound thereon, and a needle mounted for reciprocal movement toward and away from said loop taker in synchronism with rotation of said lower shaft, the improvement wherein:

said needle has a longitudinal axis inclined to an imaginary plane extending perpendicular to said axis of said lower shaft; and said loop taker has thereon a thread seizing beak having an end face extending parallel to said axis of said needle.

2. The improvement claimed in claim 1, wherein said axis of said needle is inclined at an acute angle to said plane.

3. The improvement claimed in claim 2, wherein said acute angle is 3 to 10°.

4. The improvement claimed in claim 1, wherein said axis of said needle is within another plane within which extends said axis of said lower shaft.

5. The improvement claimed in claim 4, wherein said needle is inclined upwardly in a direction toward said lower shaft.

6. The improvement claimed in claim 4, wherein said needle is inclined upwardly in a direction away from said lower shaft.

* * * * *